US009698534B2

(12) United States Patent
Bopp et al.

(10) Patent No.: US 9,698,534 B2
(45) Date of Patent: Jul. 4, 2017

(54) ELECTRICAL CONNECTOR HAVING CROSSTALK COMPENSATION INSERT

(71) Applicant: CommScope Technologies LLC, Hickory, NC (US)

(72) Inventors: Steven Richard Bopp, Jamestown, NC (US); Ralph Sykes Martin, Mount Airy, NC (US); Paul John Pepe, Clemmons, NC (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 0 days.

(21) Appl. No.: 14/953,809

(22) Filed: Nov. 30, 2015

(65) Prior Publication Data

US 2016/0204552 A1 Jul. 14, 2016

Related U.S. Application Data

(63) Continuation of application No. 14/075,772, filed on Nov. 8, 2013, now Pat. No. 9,203,192, which is a continuation of application No. 13/010,508, filed on Jan. 20, 2011, now Pat. No. 8,647,146.

(51) Int. Cl.

| | |
|---|---|
| ***H01R 13/6466*** | (2011.01) |
| ***H01R 13/6461*** | (2011.01) |
| ***H01R 24/64*** | (2011.01) |
| *H01R 4/24* | (2006.01) |

(52) U.S. Cl.

CPC ..... *H01R 13/6461* (2013.01); *H01R 13/6466* (2013.01); *H01R 24/64* (2013.01); *H01R 4/242* (2013.01)

(58) Field of Classification Search

CPC ..... H01R 13/719; H01R 24/64; H01R 12/57; H01R 12/596; H01R 12/718; H01R 12/727; H01R 13/6461; H01R 13/6466; H01R 13/6469; H01R 13/6471; H01R 13/6593; H01R 13/6594; H01R 13/6595; H01R 13/66

See application file for complete search history.

(56) References Cited

U.S. PATENT DOCUMENTS

| | | | |
|---|---|---|---|
| 5,061,198 | A | 10/1991 | Manabe et al. |
| 5,556,307 | A | 9/1996 | Johnston |
| 5,905,637 | A | 5/1999 | Su |
| 5,967,801 | A | 10/1999 | Martin et al. |

(Continued)

*Primary Examiner* — Truc Nguyen

(74) *Attorney, Agent, or Firm* — Merchant & Gould P.C.

(57) ABSTRACT

An electrical connector includes a front wire terminal and a rear wire terminal. The front wire terminal and the rear wire terminal are configured to couple to a conductor of a cable. A front signal trace is coupled to the front wire terminal. A rear signal trace is coupled to the rear wire terminal. The front signal trace is positioned adjacent to the rear signal trace. A front mating contact is coupled to the front signal trace. A rear mating contact is coupled to the rear signal trace. The front signal trace conveys an electrical signal between the front wire terminal and the front mating contact. The rear signal trace conveys an electrical signal between the rear wire terminal and the rear mating contact. An electro-mechanical compensation is positioned between the front signal trace and the rear signal trace to control crosstalk between the front signal trace and the rear signal trace.

16 Claims, 6 Drawing Sheets

(56) References Cited

U.S. PATENT DOCUMENTS

| | | | |
|---|---|---|---|
| 5,971,792 | A | 10/1999 | Lin |
| 5,971,812 | A | 10/1999 | Martin |
| 6,007,368 | A | 12/1999 | Lorenz et al. |
| 6,010,353 | A | 1/2000 | Ensz et al. |
| 6,062,895 | A | 5/2000 | Lin et al. |
| 6,113,400 | A | 9/2000 | Martin et al. |
| 6,116,943 | A | 9/2000 | Ferrill et al. |
| 6,193,526 | B1 | 2/2001 | Milner et al. |
| 6,193,542 | B1 | 2/2001 | Marowsky et al. |
| 6,244,906 | B1 | 6/2001 | Hashim et al. |
| 6,283,768 | B1 | 9/2001 | Van Naarden |
| 6,361,354 | B1 | 3/2002 | Viklund et al. |
| 6,371,793 | B1 | 4/2002 | Doorhy et al. |
| 6,394,835 | B1 | 5/2002 | Milner et al. |
| 6,402,559 | B1 | 6/2002 | Marowsky et al. |
| 6,409,535 | B1 | 6/2002 | Marowsky et al. |
| 6,447,326 | B1 | 9/2002 | Teach et al. |
| 6,506,077 | B2 | 1/2003 | Nagel |
| 6,682,363 | B1 | 1/2004 | Chang |
| 6,692,307 | B2 | 2/2004 | Laes |
| RE38,519 | E | 5/2004 | Doorhy et al. |
| 6,799,989 | B2 | 10/2004 | Doorhy et al. |
| 6,811,445 | B2 | 11/2004 | Caveney et al. |
| 6,918,782 | B2 | 7/2005 | Foster |
| 7,018,241 | B2 | 3/2006 | Caveney et al. |
| 7,033,219 | B2 | 4/2006 | Gordon et al. |
| 7,114,985 | B2 | 10/2006 | Doorhy et al. |
| 7,168,994 | B2 | 1/2007 | Caveney et al. |
| 7,182,649 | B2 | 2/2007 | Caveney et al. |
| 7,201,618 | B2 | 4/2007 | Ellis et al. |
| 7,220,149 | B2 | 5/2007 | Pharney |
| 7,297,013 | B2 | 11/2007 | Caveney et al. |
| 7,374,458 | B2 | 5/2008 | Caveney et al. |
| 7,381,097 | B2 | 6/2008 | Ellis et al. |
| 7,425,159 | B2 | 9/2008 | Lin |
| 7,474,737 | B2 | 1/2009 | Crudele et al. |
| 7,524,206 | B2 | 4/2009 | Gutierrez et al. |
| 7,534,128 | B2 | 5/2009 | Caveney et al. |
| 7,556,536 | B2 | 7/2009 | Caveney et al. |
| 7,604,515 | B2 | 10/2009 | Siemon et al. |
| 7,651,380 | B2 | 1/2010 | Below et al. |
| 7,695,303 | B2 | 4/2010 | Chen et al. |
| 7,711,093 | B2 | 5/2010 | Crudele et al. |
| 7,713,094 | B1 | 5/2010 | Sparrowhawk |
| 7,727,025 | B2 | 6/2010 | Fogg et al. |
| 7,857,635 | B2 | 12/2010 | Goodrich et al. |
| 7,874,849 | B2 | 1/2011 | Sticker et al. |
| 7,883,376 | B2 | 2/2011 | Milette et al. |
| 7,909,656 | B1 | 3/2011 | Erickson et al. |
| 7,972,183 | B1 | 7/2011 | Lin |
| 7,980,899 | B2 | 7/2011 | Siemon et al. |
| 8,016,621 | B2 | 9/2011 | Bopp et al. |
| 8,038,482 | B2 | 10/2011 | Erickson et al. |
| 8,043,124 | B2 | 10/2011 | Caveney et al. |
| 8,113,864 | B2 | 2/2012 | Chiang |
| 8,197,286 | B2 | 6/2012 | Larsen et al. |
| 8,235,757 | B2 | 8/2012 | Brear |
| 8,257,117 | B2 | 9/2012 | Pepe et al. |
| 8,298,922 | B2 | 10/2012 | Schumann et al. |
| 8,647,146 | B2 | 2/2014 | Bopp et al. |
| 9,203,192 | B2 | 12/2015 | Bopp et al. |
| 9,245,828 | B2 * | 1/2016 | Gupta ..... H01L 23/488 |
| 2005/0073038 | A1 * | 4/2005 | Kuo ..... H01L 23/49838 257/690 |
| 2005/0090154 | A1 | 4/2005 | Ikeda et al. |
| 2009/0200657 | A1 * | 8/2009 | Liu ..... H01L 24/49 257/691 |
| 2010/0223786 | A1 | 9/2010 | Caveney et al. |
| 2010/0227496 | A1 | 9/2010 | Sticker et al. |
| 2012/0094525 | A1 | 4/2012 | Maranto et al. |
| 2012/0100744 | A1 | 4/2012 | Bolouri-Saransar et al. |
| 2012/0190246 | A1 | 7/2012 | Pepe et al. |

* cited by examiner

ELECTRICAL CONNECTOR HAVING CROSSTALK COMPENSATION INSERT

CROSS REFERENCE TO RELATED APPLICATIONS

This application is a continuation of application Ser. No. 14/075,772, filed Nov. 8, 2013, now U.S. Pat. No. 9,203,192, which is a continuation of application Ser. No. 13/010,508, filed Jan. 20, 2011, now U.S. Pat. No. 8,647,146, which applications are incorporated herein by reference in their entirety.

FIELD OF THE INVENTION

The subject matter described herein relates to an electrical connector and, more particularly, to an electrical connector having a crosstalk compensation insert.

BACKGROUND OF THE INVENTION

Electrical connectors are commonly used to couple a cable to a corresponding jack, cable, electrical device or the like. The electrical connector includes wire terminals positioned at a wire end of the connector. The wire terminals are configured to terminate twisted pairs of the cable and are generally housed in a load bar that is positioned within the connector. Specifically, each wire of a twisted pair is separated and joined to a terminal in the load bar. Contacts are coupled to the load bar at a mating end of the connector. The load bar carries electrical signals, for example, power and/or data signals, from the cable to the contacts. The contacts are configured to mate with corresponding contacts of the jack, cable, electrical device or the like. Accordingly, the connector carries the electrical signals from the cable to the corresponding jack, cable, electrical device or the like.

However, conventional electrical connectors are not without their disadvantages. In some electrical connectors wire terminals are positioned in close proximity to one another. Accordingly, electromagnetic crosstalk may be experienced between the wire terminals. Specifically, the wire terminals may experience crosstalk between differential pairs of the cable. Excessive crosstalk may impair the performance of the connector. For example, the crosstalk may reduce a speed at which the connector is capable of carrying the electrical signals. The crosstalk may also interfere with the electrical signals, thereby rendering the connector inoperable.

A need remains for an electrical connector that controls crosstalk between the differential pairs of a cable.

SUMMARY OF THE INVENTION

In one embodiment, an electrical assembly for a connector is provided. The assembly includes an insert having a wire end and a mating end. The insert has a front mounting surface positioned proximate to the wire end of the insert and a rear mounting surface positioned distally from the wire end of the insert. The rear mounting surface is stepped up from the front mounting surface with respect to a bottom of the insert. Wire terminals are coupled to the front mounting surface and the rear mounting surface. Signal traces extend from the wire end of the insert to the mating end of the insert. Each of the signal traces is coupled to one of the wire terminals. The signal traces include front signal traces and rear signal traces. An electro-mechanical compensation is positioned between the wire end and the mating end of the insert. The electro-mechanical compensation is positioned between the front signal traces and the rear signal traces.

In another embodiment, an electrical connector is provided. The connector includes a housing having a wire end and a mating end. An insert is positioned within the housing. The insert has a wire end positioned proximate to the wire end of the housing and a mating end positioned proximate to the mating end of the housing. The insert has a front mounting surface positioned proximate to the wire end of the insert and a rear mounting surface positioned distally from the wire end of the insert. The rear mounting surface is stepped up from the front mounting surface with respect to a bottom of the insert. Wire terminals are coupled to the front mounting surface and the rear mounting surface. Signal traces extend from the wire end of the insert to the mating end of the insert. Each of the signal traces is coupled to one of the wire terminals. The signal traces include front signal traces and rear signal traces. An electro-mechanical compensation is positioned between the wire end and the mating end of the insert. The electro-mechanical compensation is positioned between the front signal traces and the rear signal traces.

In another embodiment, an electrical assembly for a connector is provided. The assembly includes an insert having wire end and a mating end. The insert has a front mounting surface positioned proximate to the wire end and a rear mounting surface positioned distally from the wire end. Wire terminals are joined to the insert. The wire terminals include front wire terminals joined to the front mounting surface and rear wire terminals joined to the rear mounting surface. Signal traces extend from the wire terminals. The signal traces include front signal traces joined to the front wire terminals and rear signal traces joined to the rear wire terminals. An electro-mechanical compensation is positioned between the wire end and the mating end of the insert. The electro-mechanical compensation is positioned between the front signal traces and the rear signal traces.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
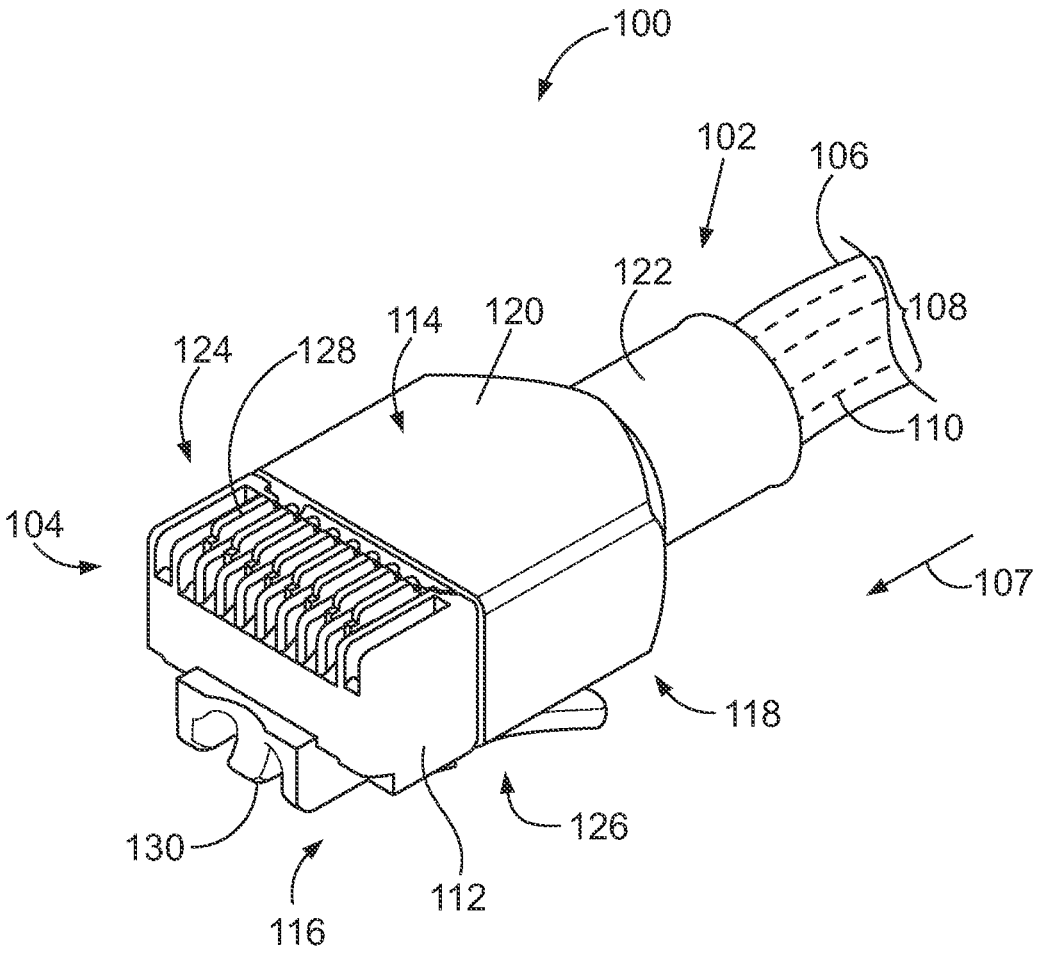
FIG. 1 is a perspective top view of an electrical connector formed in accordance with an embodiment.

FIG. 1 illustrates an electrical connector 100 formed in accordance with an embodiment. In an exemplary embodiment, the electrical connector is a RJ-45 plug. However, the embodiments described herein may be used with any suitable connector, receptacle or plug. The electrical connector 100 includes a wire end 102 and a mating end 104. The wire end 102 is configured to be joined to a cable 106. The cable 106 is inserted into the wire end 102 of the connector 100 in a loading direction 107. The cable 106 includes a conductor 108 having wires 110 arranged in twisted pairs. In one embodiment, the wires 110 are arranged in differential pairs which enable signal transmission via one signal on two separate wires which have a voltage potential difference that is approximately 180 degrees out of phase with each other. The wires 110 of the cable 106 are configured to be electrically coupled to the connector 100. The mating end 104 of the connector 100 is configured to join a corresponding connector (not shown).

The connector 100 includes a housing 112 and a shield 114. The housing 112 may have a size similar to that of a Cat.-6 housing. Cat.-6 cable is the standard for Gigabit Ethernet and other network protocols that are backward compatible with the Category 5/5e and Category 3 cable standards. Cat.-6 features more stringent specifications for crosstalk and system noise. The Cat.-6 cable standard provides performance of up to 250 MHz and is suitable for 10BASE-T, 100BASE-TX (Fast Ethernet), 1000BASE-T/1000BASE-TX (Gigabit Ethernet) and 10GBASE-T (10-Gigabit Ethernet). Cat.-6 cable has a reduced maximum length when used for 10GBASE-T, is characterized to 500 MHz and has improved alien crosstalk characteristics.

In an exemplary embodiment, the housing 112 is formed from polycarbonate. Alternatively, the housing 112 may be formed from any suitable non-conductive material. The housing 112 has a mating end 116 and a wire end 118. The shield 114 is joined to the wire end 118 of the housing 112. The shield 114 includes a housing portion 120 and a cable portion 122. The housing portion 120 is joined to the wire end 118 of the housing 112. The cable portion 122 extends from the housing portion 120. The cable portion 122 is joined to the cable 106. The shield 114 protects the connector 100 from electro-magnetic interference.

The housing 112 includes a top 124 and a bottom 126. The top 124 of the housing 112 includes a plurality of mating contacts 128. The mating contacts 128 are configured to electrically couple to contacts positioned on the corresponding connector. The mating contacts 128 create an electrical connection between the connector 100 and the corresponding connector. The mating contacts 128 may be formed from phos-bronze. The mating contacts 128 may include a gold plated surface. Alternatively, the mating contacts 128 may be formed from any suitable conductive material and/or have any suitable conductive plating.

The bottom 126 of the connector 100 includes a latch 130. The latch 130 is configured to engage a corresponding mechanism on the corresponding connector. The latch 130 secures the connector 100 to the corresponding connector. In an alternative embodiment, the connector 100 and the corresponding connector may include any suitable corresponding engagement mechanisms to join the connector 100 to the corresponding connector.

Figure 2:
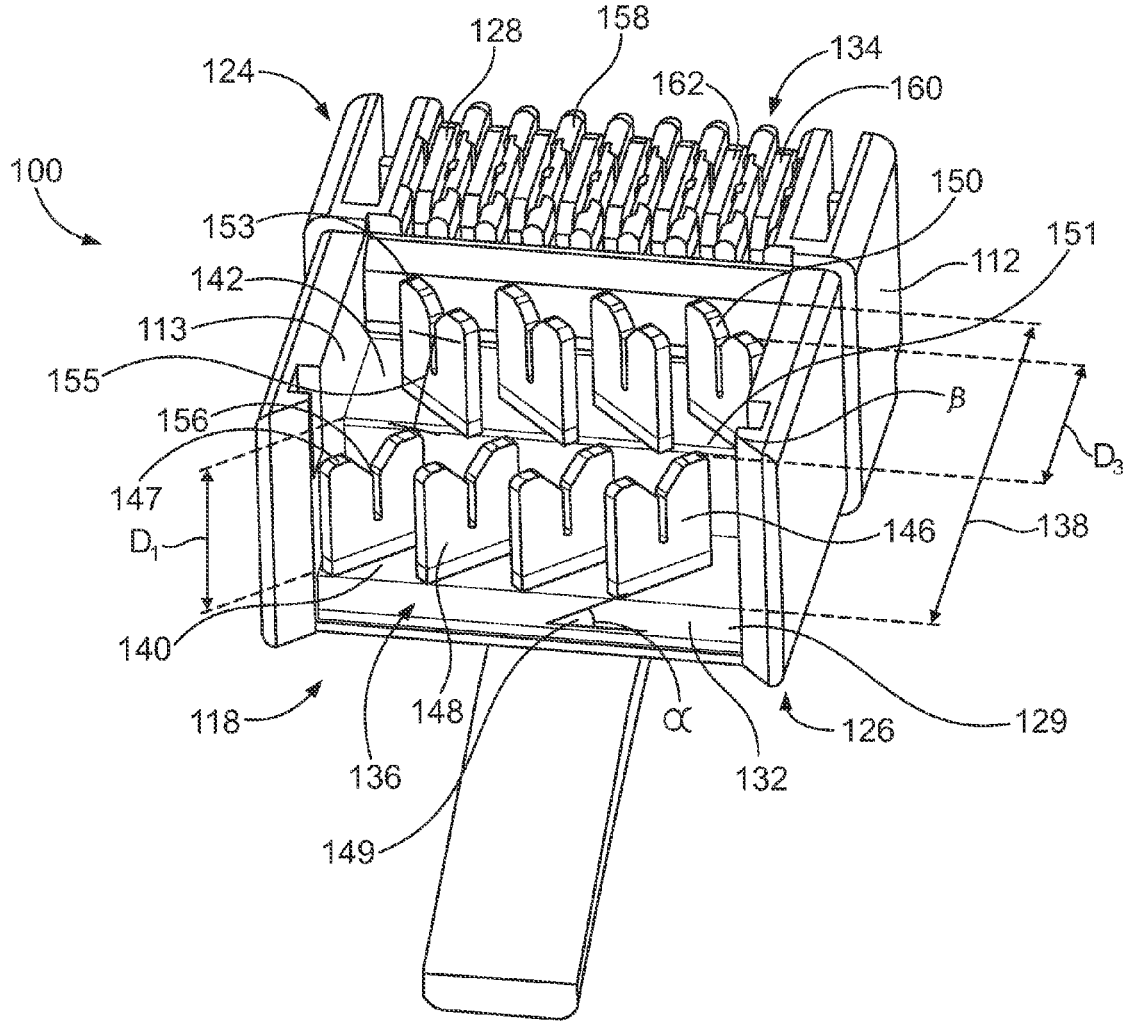
FIG. 2 is a perspective top view of the electrical connector shown in FIG. 1 and having the shield removed.

FIG. 2 illustrates the electrical connector 100 with the shield 114 removed. FIG. 2 illustrates the housing 112. The housing 112 includes a cavity 113. An electrical assembly 132 is positioned within the housing 112. The electrical assembly 132 is positioned within the cavity 113. In one embodiment, an interference fit is created between the electrical assembly 132 and the housing 112. Alternatively, the electrical assembly 132 and the housing 112 may include engagement mechanisms, for example, slots, notches, tabs, or the like to retain the electrical assembly 132 within the housing 112. The electrical assembly 132 may be slid into the housing 112 from the wire end 118 of the housing 112. The housing 112 may include tabs along the wire end 118 thereof. The tabs may retain the electrical assembly 132 within the housing 112.

The electrical assembly 132 includes a insert 129 having a mating end 134 positioned proximate to the mating end 116 of the housing 112 and a wire end 136 positioned proximate to the wire end 118 of the housing 112. The electrical assembly 132 is configured to carry electrical signals through the connector 100. The electrical signals may include data and/or power signals. The electrical signals are carried from the cable 106 (shown in FIG. 1) to the corresponding connector (not shown).

The wire end 136 of the insert 129 includes a wire terminal area 138. The wire terminal area 138 is configured to be contained by the shield 114 when the shield 114 is positioned on the housing 112. The wire terminal area 138 includes a front mounting surface 140 and a rear mounting surface 142. The front mounting surface 140 is positioned closer to the wire end 136 of the insert 129 than the rear mounting surface 142. The front mounting surface 140 is positioned proximate to the wire end 136 of the insert 129. The rear mounting surface 142 is positioned distally from the wire end 136 between the front mounting surface 140 and the mating end 134 of the insert 129. The front mounting surface 140 is positioned proximate to the bottom 126 of the housing 112. The rear mounting surface 142 is stepped up a distance $D_1$ from the front mounting surface 140 with respect to a bottom 170 of the insert 129. The rear mounting surface 142 is positioned between the front mounting surface 140 and the top 124 of the housing 112. The rear mounting surface 142 and the front mounting surface 140 are offset to provide a predetermined tuning for the connector 100. In an alternative embodiment, each of the front mounting surface 140 and the rear mounting surface 142 may be aligned within the same plane. In one embodiment, the insert 129 may include only one mounting surface having each of the wire terminals 146 mounted thereto.

The wire terminal area 138 is configured with a plurality of wire terminals 146. The wire terminals 146 may be formed from phos-bronze and/or include a matte-tin over nickel plating. Optionally, the wire terminals 146 may be formed from any suitable conductive material. In an exemplary embodiment of the invention, the wire terminals 146 are configured as blades. Front wire terminals 148 are joined to the front mounting surface 140 and rear wire terminals 150 are joined to the rear mounting surface 142. The front wire terminals 148 extend in a plane 149 that is non-orthogonal with respect to the wire end 136 of the insert 129. The plane 149 is non-orthogonal to the loading direction 107 of the cable 106. The front wire terminals 148 are arranged at an angle $\alpha$ with respect to the wire end 136 of the insert 129. In one embodiment, the angle $\alpha$ may be 45 degrees.

The rear wire terminals 150 extend in a plane 151 that is non-orthogonal to the wire end 136 of the insert 129. The plane 151 is non-orthogonal to the loading direction 107 of the cable 106. The rear wire terminals 150 are arranged at an angle $\beta$ with respect to the wire end 136 of the insert 129. In one embodiment, the angle $\beta$ may be 45 degrees. The angle α is opposite the angle β. In an exemplary embodiment, the front wire terminals 148 are arranged 90 degrees with respect to the rear wire terminals 150. The plane 149 of the front wire terminals 148 is non-parallel to the plane 151 of the rear wire terminals 150. In another embodiment, the front wire terminals 148 and the rear wire terminals 150 may be arranged at any angle with respect to one another. Optionally, the front wire terminals 148 may each be arranged at different angles α and the rear wire terminals 150 may each be arranged at different angles β. The angles α and β are configured to provide predetermined tuning for the connector 100.

The wire terminals 146 are mounted to the wire terminal area 138. For example, the wire terminals 146 may be surface mounted to the wire terminal area 138. The wire terminals 146 may be soldered, welded, or adhesively coupled to the wire terminal area 138. In one embodiment, the wire terminals 146 include an eye-of-the needle contact that is received in an aperture formed in the wire terminal area 138. The front wire terminals 148 are mounted to the front mounting surface 142 and the rear wire terminals 150 are mounted to the rear mounting surface 142. The rear wire terminals 150 have a top 153 that is stepped up a distance $D_3$ from a top 147 of the front wire terminals 148.

The wire terminals 146 include a slot 156. The slot 156 is configured to receive a wire 110 (shown in FIG. 1) of the cable 106 (shown in FIG. 1). The slot 156 may be configured to receive a stranded and/or solid wire. In one embodiment, the wire terminal 146 may include any number of slots 156 to receive any number of wires 110. The wire 110 is retained within the slot 156 through an interference fit. Optionally, the wire 110 may be soldered to the wire terminal 146 after the wire 110 is inserted into the slot 156. A first wire of a differential pair is configured to be joined to a front wire terminal 148. A second wire of the differential pair is configured to be joined to a rear wire terminal 150. The wires of the differential pairs of the cable 106 are separated between the front wire terminals 148 and the rear wire terminals 150. Optionally, each wire 110 of a differential pair may be joined to front wire terminals 148 or rear wire terminals 150.

The mating contacts 128 are positioned proximate to the mating end 134 of the insert 129. The mating contacts 128 extend toward the top 124 of the housing 112. The housing 112 includes partitions 158. The mating contacts 128 are positioned between adjacent partitions 158. The mating contacts 128 are electrically coupled to the wire terminals 146. The mating contacts 128 include front mating contacts 160 and rear mating contacts 162. The front mating contacts 160 are electrically joined to the front wire terminals 148. The rear mating contacts 162 are electrically joined to the rear wire terminals 150. The terms "front" and "rear" as used with respect to the mating contacts 128 designates the wire terminal 146 to which the mating contact 128 is joined. The terms "front" and "rear" as used with respect to the mating contacts 128 are not used to designate a position of the mating contacts 128. The mating contacts 128 are arranged in parallel. In another embodiment, the mating contacts 128 may be offset from one another. The front mating contacts 160 are positioned between adjacent rear mating contacts 162 and the rear mating contacts 162 are positioned between adjacent front mating contacts 160. The front mating contacts 160 and the rear mating contacts 162 are alternated to achieve a predetermined tuning for the connector 100. In another embodiment, the front mating contacts 160 and the rear mating contacts 162 may be arranged in any order that provides a predetermined performance of the connector.

Figure 3:
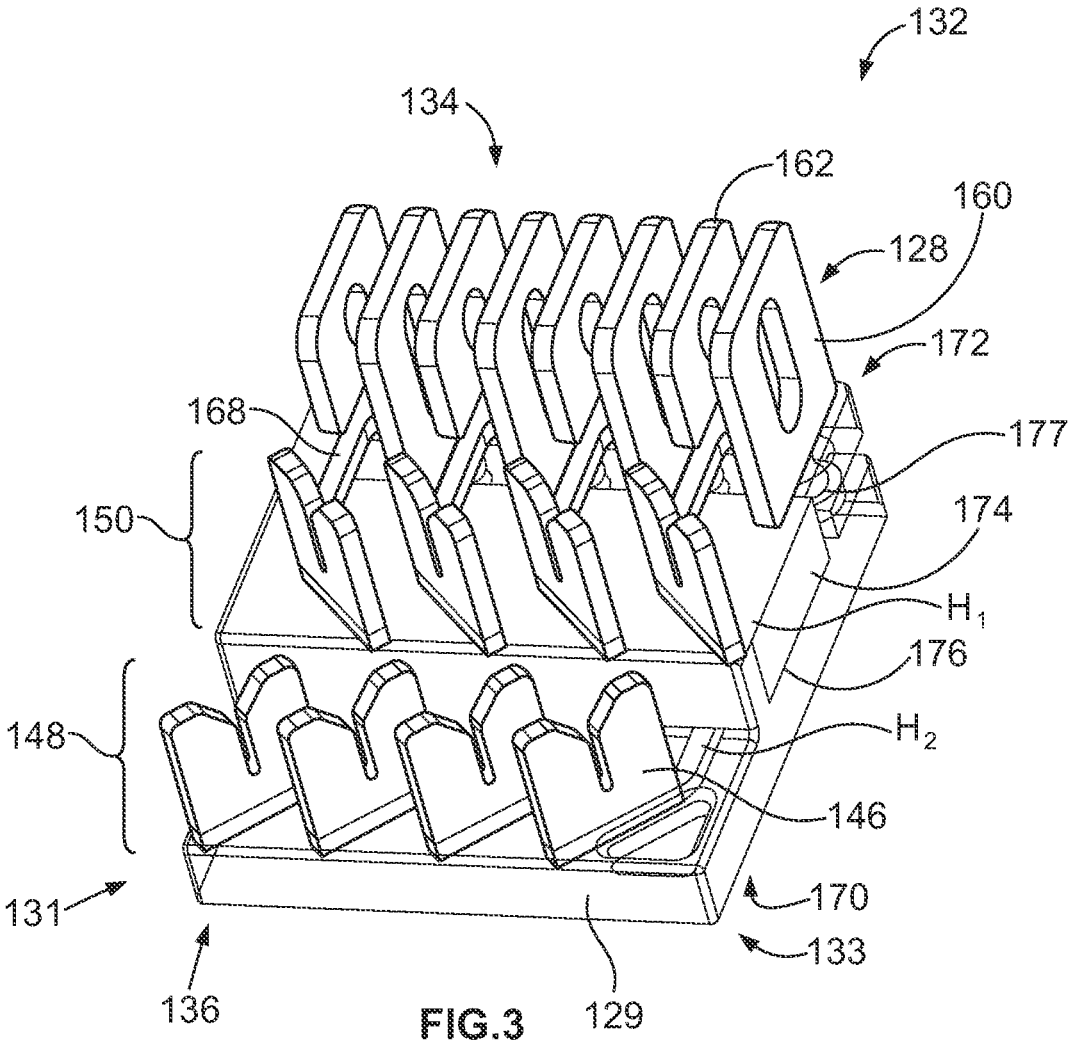
FIG. 3 is a perspective top view of an electrical assembly formed in accordance with an embodiment.

FIG. 3 illustrates the electrical assembly 132. The insert 129 includes signal traces 164 extending between the wire end 136 and the mating end 134 of the insert 129. The signal traces 164 extend between the wire terminals 146 and the mating contacts 128 to electrically couple the wire terminals 146 and the mating contacts 128. Each signal trace 164 joins a wire terminal 146 to a mating contact 128. Alternatively, each signal trace 164 may join multiple wire terminals 146 to a mating contact 128 and/or multiple mating contacts 128 to a wire terminal 146. Electrical signals are carried by the signal traces 164 between the wire terminals 146 and the mating contacts 128.

The signal traces 164 include front signal traces 166 and rear signal traces 168. The front signal traces 166 join the front wire terminals 148 to the front mating contacts 160. The rear signal traces 168 join the rear wire terminals 150 to the rear mating contacts 162. The terms "front" and "rear" as used with respect to the signal traces 164 designates the wire terminal 146 to which the signal trace 164 is joined. The terms "front" and "rear" as used with respect to the signal traces 164 are not used to designate a position of the signal traces 164. The front signal traces 166 extend proximate to a bottom 170 of the insert 129. The rear signal traces 168 extend proximate to a top 172 of the insert 129. Alternatively, the front signal traces 166 may extend proximate to the top 172 of the insert 129 and/or the rear signal traces 168 may extend proximate to the bottom 170 of the insert 129. The front signal traces 166 and the rear signal traces 168 extend in parallel to one another. Alternatively, the front signal traces 166 and the rear signal traces 168 may extend at angles with respect to one another. In the illustrated embodiment, the front signal traces 166 and the rear signal traces 168 alternate from a first side 131 of the insert 129 to a second side 133 of the insert 129. Optionally, the front signal traces 166 and the rear signal traces 168 may be arranged in any suitable manner through the insert 129.

An electro-mechanical compensation 174 (also shown in FIG. 5) is positioned within the insert 129. The electro-mechanical compensation 174 is positioned at an intermediate location between the mating end 134 and the wire end 136 of the insert 129. The electro-mechanical compensation 174 is positioned between the wire terminals 146 and the mating contacts 128. In one embodiment, an electro-mechanical compensation 174 may be aligned with the wire terminals 146 and/or the mating contacts 128. The electro-mechanical compensation 174 is positioned between the front signal traces 166 and the rear signal traces 168. The front signal traces 166 extend below a bottom 176 of the electro-mechanical compensation 174 and the rear signal traces 168 extend above a top 177 of the electro-mechanical compensation 174. Alternatively, the front signal traces 166 and/or the rear signal traces 168 may extend along the top 177 and/or the bottom 176 of the electro-mechanical compensation 174.

In one embodiment, the electro-mechanical compensation 174 is a circuit board, for example, a printed circuit board. Optionally, the electro-mechanical compensation 174 may be a flexible substrate. The electro-mechanical compensation 174 is electrically coupled to the front signal traces 166 and the rear signal traces 168. The electro-mechanical compensation 174 capacitively couples the front signal traces 166 to the rear signal traces 168. The electro-mechanical compensation 174 capacitively couples the front signal trace 166 of a differential pair to the rear signal trace 168 of the differential pair. The electro-mechanical compensation 174 controls crosstalk between the front signal traces 166 and the rear signal traces 168 to control an amount of crosstalk generated within the connector 100.

Figure 4:
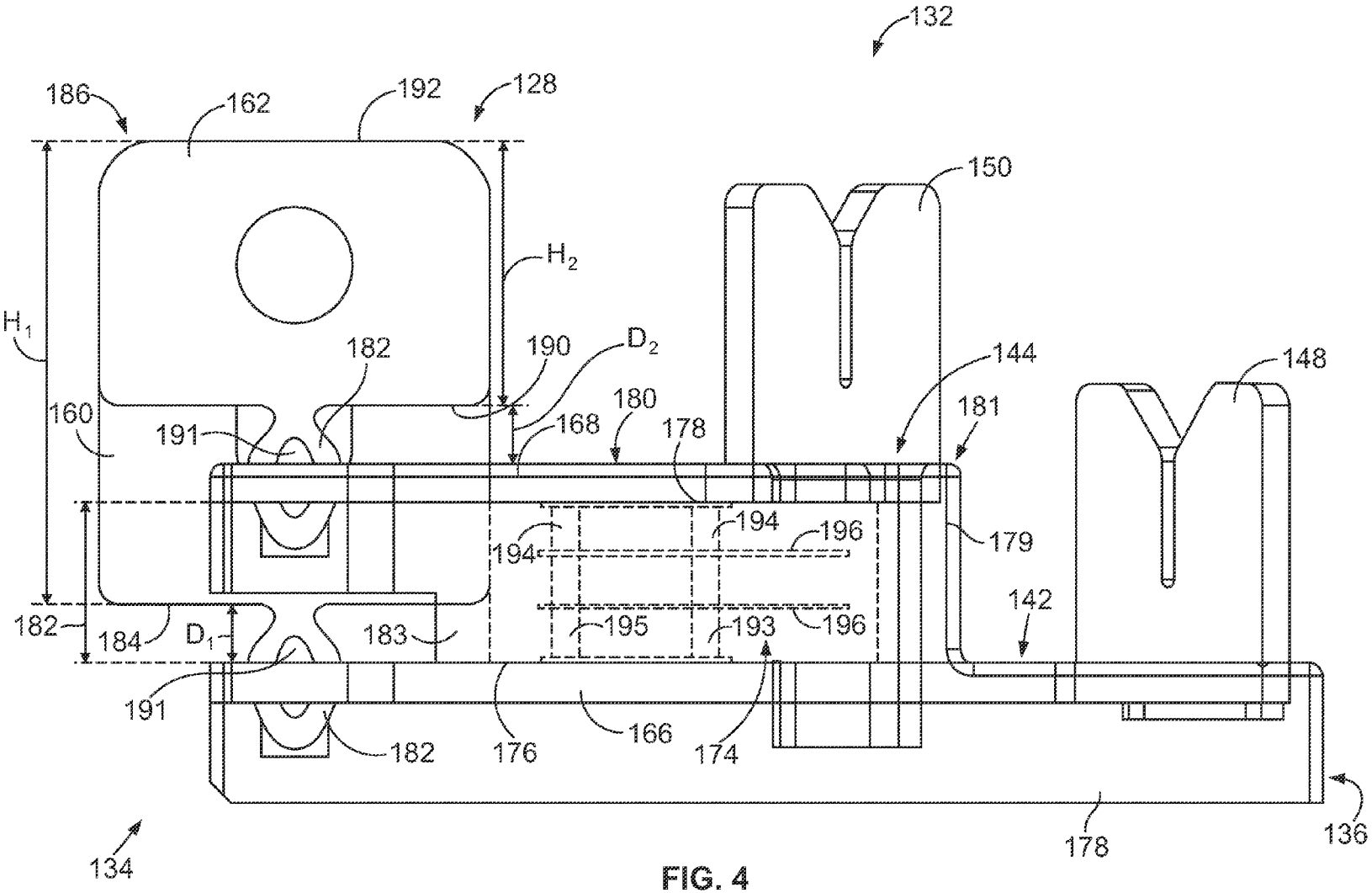
FIG. 4 is a side view of the electrical assembly shown in FIG. 3.

FIG. 4 illustrates a side view of the electrical assembly 132. The insert 129 includes the mating end 134 and the wire end 136. A bottom panel 178 extends between the mating end 134 and the wire end 136. A top panel 180 extends from the mating end 134 toward the wire end 136. In an exemplary embodiment the top panel 180 extends only partially along the length of the bottom panel 178. The top panel 180 and the bottom panel 178 are separated by a gap 182. The top panel 180 is joined to the bottom panel 178 by a connector segment 179. The connector segment 179 extends from an end 181 of the top panel 180 to the bottom panel 178. Another connector segment 183 extends between the top panel 180 and the bottom panel 178 proximate to the mating end 134 of the insert 129. The connector segments 179 and 183 maintain the gap 182 between the top panel 180 and the bottom panel 178.

The front mounting surface 142 is positioned on the bottom panel 178. The rear mounting surface 142 is positioned on the top panel 180. The front wire terminals 148 are joined to the bottom panel 178. The front signal traces 166 extend along the bottom panel 178 between the front wire terminals 148 and the mating end 134 of the insert 129. The rear wire terminals 150 are joined to the top panel 180. The rear signal traces 168 extend along the top panel 180 between the rear wire terminals 150 and the mating end 134 of the insert 129.

The mating contacts 128 are joined to the mating end 134 of the insert 129. The mating contacts 128 include connectors 191 that are configured to extend through the mating end 134 of the insert 129. In the illustrated embodiment, the connectors 191 are formed as eye-of-the-needle connectors that are configured to be inserted into the insert 129. Alternatively, the mating contacts 128 may be surface mounted to the insert 129 by soldering, welding, adhesion, or the like.

The front mating contacts 160 are joined to the bottom panel 178. The rear mating contacts 162 are joined to the top panel 180. The front mating contacts 160 include a bottom 184 and a top 186. The front mating contacts 160 are joined to the bottom panel 178 such that the bottom 184 of each front mating contact 160 is positioned a distance $D_1$ from the bottom panel 178. Alternatively, the bottom 184 of at least one front mating contact 160 may abut the bottom panel 178. The front mating contacts 160 have a height $H_1$ extending between the bottom 184 and the top 186. The rear mating contacts 162 include a bottom 190 and a top 192. The rear mating contacts 162 are joined to the top panel 180 such that the bottom 190 of each rear mating contact 162 is positioned a distance $D_2$ from the top panel 180. Alternatively, the bottom 190 of at least one rear mating contact 162 may abut the top panel 180. The rear mating contacts 162 have a height $H_2$ defined between the bottom 190 and the top 192. The height $H_1$ of the front mating contacts 160 is greater than the height $H_2$ of the rear mating contacts 162. The top 186 of the front mating contacts 160 is aligned with the top 192 of the rear mating contacts 162. Alternatively, the tops 186 of the front mating contacts 160 may be offset from the tops 192 of the rear mating contacts 162.

The electro-mechanical compensation 174 is positioned between the top panel 180 and the bottom panel 178. The electro-mechanical compensation 174 extends between the connector segments 179 and 183. The electro-mechanical compensation 174 is positioned with the gap 182. The top 177 of the electro-mechanical compensation 174 abuts the top panel 180. The bottom 176 of the electro-mechanical compensation 174 rests on the bottom panel 178. The electro-mechanical compensation 174 is configured as a multi-layer substrate. The electro-mechanical compensation 174 includes posts 194 extending from the top 177 to the bottom 176. The posts 194 include a front post 193 and a rear post 195. The posts 194 are configured as vias that electrically couple conductive pathways 196 that are joined to the posts 194. The illustrated embodiment includes two conductive pathways 196. The conductive pathways 196 extend from the rear post 195 past the front post 193. Optionally, the electro-mechanical compensation may include any number of conductive pathways 196 extending between and/or past the posts 194. The conductive pathways 196 capacitively couple the front signal traces 166 and the rear signal traces 168 to reduce crosstalk therebetween.

Figure 5:
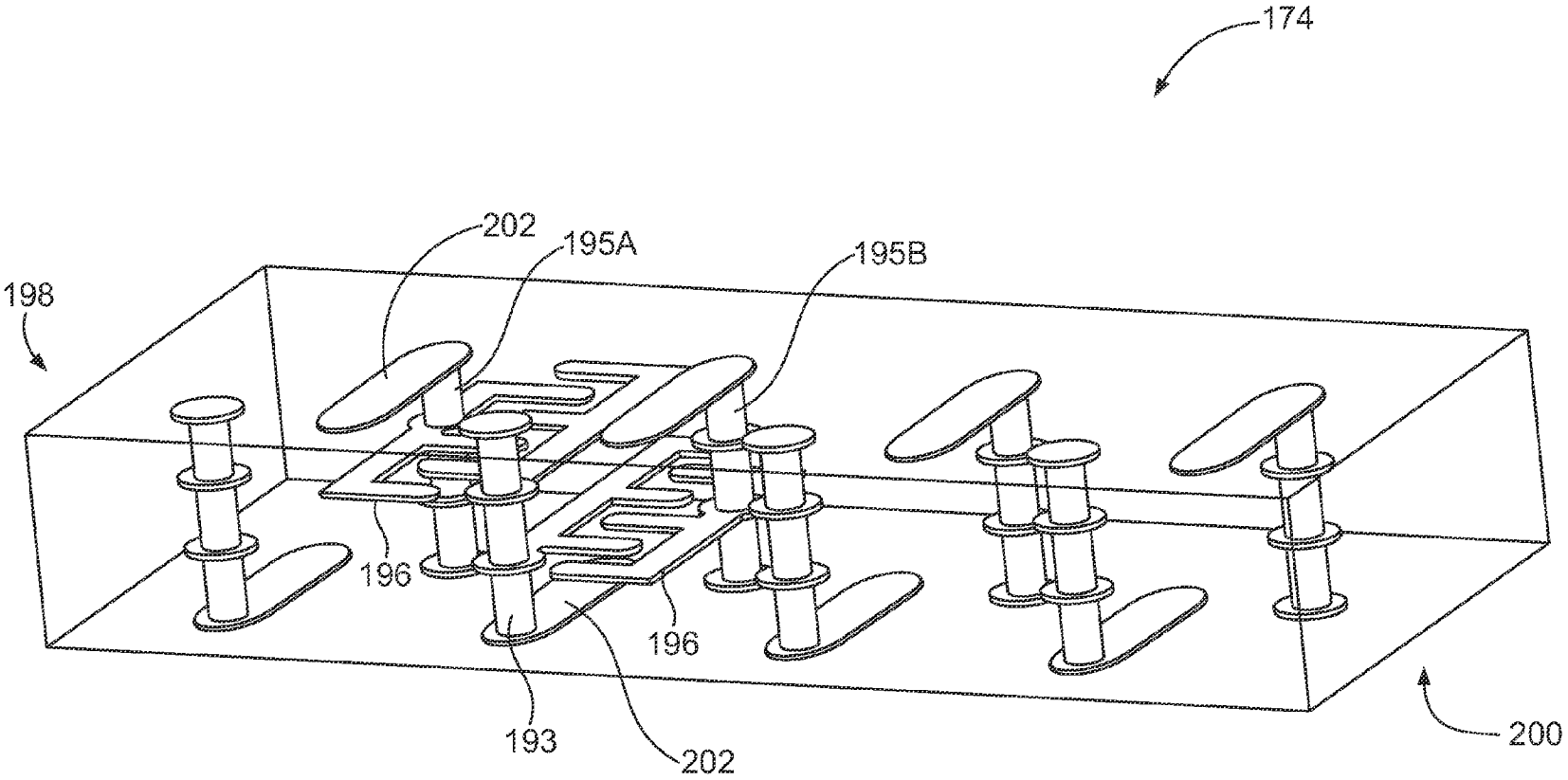
FIG. 5 is a top perspective view of an electro-mechanical compensation formed in accordance with an embodiment.

FIG. 5 illustrates a top perspective view of the electro-mechanical compensation 174. The electro-mechanical compensation includes a first end 198 and a second end 200. The front posts 193 are aligned in parallel and the rear posts 195 are aligned in parallel. The front posts 193 are offset from the rear posts 195. In an example embodiment, each front post 193 is equally offset from the rear posts 195. Alternatively, the front posts 193 may be offset from the rear posts 195 at varying distances. The front posts 193 and the rear posts 195 alternate between the first end 198 and the second end 200 of the electro-mechanical compensation 174. A conductive pad 202 is joined to each post 194. The conductive pad 202 is configured to couple to a corresponding signal trace 164. The front signal traces 166 couple to the conductive pads 202 of the front posts 193. The rear signal traces 168 couple to the conductive pads 202 of the rear posts 195.

The conductive pathways 196 are joined to the posts 194. The illustrated embodiment includes conductive pathways 196 joined to three of the posts 194. In an exemplary embodiment, at least one conductive pathway 196 is joined to each post 194. In the illustrated embodiment, a front post 193 includes two conductive pathways 196 coupled thereto. The adjacent rear posts 195 each include a conductive pathway 196. The adjacent rear posts 195 include a first rear post 195*a* and a second rear post 195*b*. Each conductive pathway 196 of the front post 193 is positioned adjacent to the conductive pathway 196 of one of the first rear post 195*a* and the second rear post 195*b*. The adjacent conductive pathways 196 capacitively couple the front post 193 to the adjacent rear posts 195.

Figure 6:
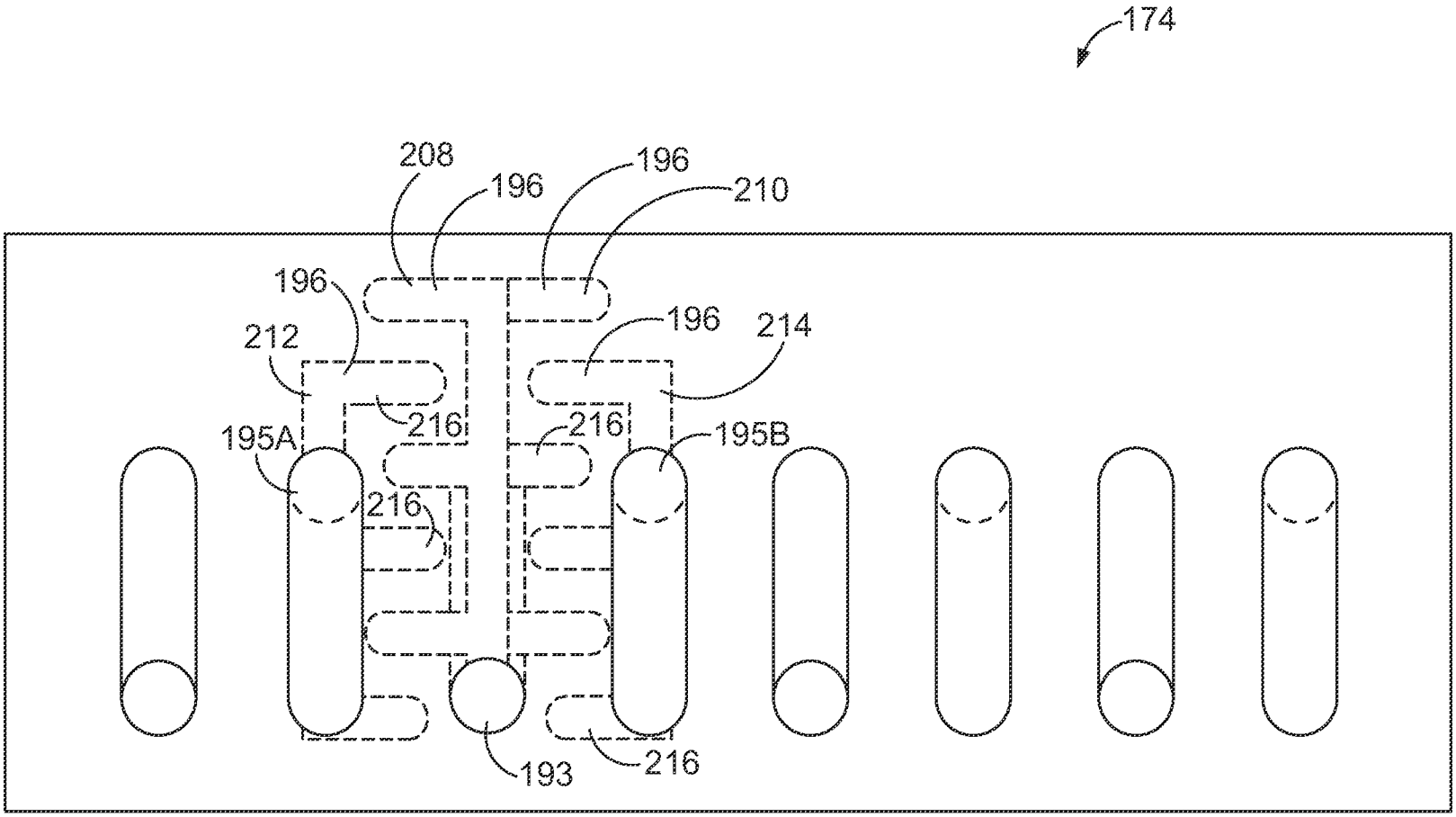
FIG. 6 is a top view of the electro-mechanical compensation shown in FIG. 5.

FIG. 6 illustrates a top view of the electro-mechanical compensation 174. Conductive pathways 196 are joined to a front post 193, a first rear post 195*a*, and a second rear post 195*b*. The first rear post 195*a* and the second rear post 195*b* are joined to rear signal traces 168 (shown in FIG. 4). The front post 193 is joined to a front signal trace 166 (shown in FIG. 4). The first rear post 195*a* and the second rear post 195*b* are positioned adjacent to the front post 193. The front post 193 includes a first conductive pathway 208 and a second conductive pathway 210. The first rear post 195*a* includes a first rear conductive pathway 212 and the second rear post 195*b* includes a second rear conductive pathway 214.

Each of the conductive pathways 208, 210, 212, and 214 include fingers 216. In an exemplary embodiment, the fingers 216 are interdigital fingers. The interdigital fingers operate as capacitive couplers that couple the conductive pathways 208, 210, 212, and 214. The fingers 216 of the first conductive pathway 208 extend toward the first rear post 195*a*. The fingers 216 of the first conductive pathway 208 are arranged in an alternating pattern with respect to the fingers 216 of the first rear conductive pathway 212. The fingers 216 capacitively couple the first conductive pathway 208 and the first rear conductive pathway 212. The fingers 216 of the second conductive pathway 210 extend toward the second rear post 195*b*. The fingers 216 of the second conductive pathway 210 are arranged in an alternating pattern with respect to the fingers 216 of the second rear conductive pathway 214. The fingers 216 capacitively couple the second conductive pathway 210 and the second rear conductive pathway 214.

In an exemplary embodiment, each post 194 includes conductive pathways 196 that are configured to capacitively couple the post 194 to each adjacent post 194. Each front post 193 is capacitively coupled to each adjacent rear post 195 such that the front signal traces 166 are capacitively coupled to each adjacent rear signal trace 168. The electro-mechanical compensation 174 capacitively couples the front signal traces 166 and the rear signal traces 168 to control crosstalk between the front signal traces 166 and the rear signal traces 168, thereby controlling crosstalk between the differential pairs of the cable 106 (shown in FIG. 1). The electro-mechanical compensation 174 may eliminate crosstalk with the connector 100 and/or may limit the crosstalk to a predetermined level. The electro-mechanical compensation 174 provides surface mounted and/or non-ohmic electromagnetic crosstalk compensation between the signal traces 166 and 168. The electro-mechanical compensation 174 controls crosstalk within the connector 100 to achieve a predetermined performance level of the connector 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical assembly for a connector comprising:

an insert having a wire end and a mating end, the insert having a front mounting surface positioned proximate to the wire end of the insert and a rear mounting surface positioned distally from the wire end of the insert, the rear mounting surface vertically displaced from the front mounting surface with respect to a bottom of the insert, wire terminals coupled to the front mounting surface and the rear mounting surface;

signal traces extending from the wire end of the insert to the mating end of the insert, each of the signal traces coupled to one of the wire terminals, the signal traces including front signal traces and rear signal traces; and an electro-mechanical compensation positioned between the wire end and the mating end of the insert, the electro-mechanical compensation including a multi-layer circuit board with at least first and second conductive posts extending through layers of the multi-layer circuit board and being connected to respective first and second ones of the signal traces, and first and second conductive pathways connected respectively to the first and second conductive posts to capacitively couple the first and second ones of the signal traces.

2. The electrical assembly of claim 1, wherein front signal traces extend proximate to a bottom of the insert and the rear signal traces extend proximate to a top of the insert, and wherein the first one of the signal traces is a front signal trace, and the second one of the signal traces is a rear signal trace.

3. The electrical assembly of claim 1, wherein the wire terminals include front wire terminals joined to the front mounting surface and rear wire terminals joined to the rear mounting surface, the front wire terminals coupled to the front signal traces and the rear wire terminals coupled to the rear signal traces, and wherein the first post is connected to one of the front signal traces and the second post is connected to one of the rear signal traces to capacitively couple the front and rear signal traces.

4. The electrical assembly of claim 1, wherein the first and second conductive pathways of the electro-mechanical compensation are both on a common layer of the multi-layer circuit board.

5. The electrical assembly of claim 1, wherein the electro-mechanical compensation includes interdigital fingers that provide the capacitive coupling.

6. The electrical assembly of claim 1, wherein the electro-mechanical compensation is electrically coupled to the front signal traces and the rear signal traces.

7. The electrical assembly of claim 1, wherein the electro-mechanical compensation includes interdigital fingers coupled to each signal trace, the interdigital fingers coupled to a front signal trace positioned between the interdigital fingers coupled to a rear signal trace.

8. The electrical assembly of claim 1 further comprising mating contacts, each mating contact coupled to a signal trace, each signal trace conveying an electrical signal between a wire terminal and a mating contact.

9. An electrical connector comprising:

a housing having a wire end and a mating end;

an insert positioned within the housing, the insert having a wire end positioned proximate to the wire end of the housing and a mating end positioned proximate to the mating end of the housing, the insert having a front mounting surface positioned proximate to the wire end of the insert and a rear mounting surface positioned distally from the wire end of the insert, the rear mounting surface vertically displaced from the front mounting surface with respect to a bottom of the insert, wire terminals coupled to the front mounting surface and the rear mounting surface;

signal traces extending from the wire end of the insert to the mating end of the insert, each of signal traces coupled to one of the wire terminals, the signal traces including front signal traces and rear signal traces; and an electro-mechanical compensation positioned between the wire end and the mating end of the insert, the electro-mechanical compensation including a multi-layer circuit board with at least first and second conductive posts extending through layers of the multi-layer circuit hoard and being connected to respective first and second ones of the signal traces, and first and second conductive pathways connected respectively to the first and second conductive posts to capacitively couple the first and second ones of the signal traces.

10. The electrical connector of claim 9, wherein front signal traces extend proximate to a bottom of the insert and the rear signal traces extend proximate to a top of the insert.

11. The electrical connector of claim 9, wherein the wire terminals include front wire terminals joined to the front mounting surface and rear wire terminals joined to the rear mounting surface, the front wire terminals coupled to the front signal traces and the rear wire terminals coupled to the rear signal traces, and wherein the first post is connected to one of the front signal traces and the second post is connected to one of the rear signal traces to capacitively couple the front and rear signal traces.

12. The electrical connector of claim 9, wherein the first and second conductive pathways of the electro-mechanical compensation are both on a common layer of the multi-layer circuit board.

13. The electrical connector of claim 9, wherein each of the first and second conductive pathways of the electro-mechanical compensation includes interdigital fingers that provide the capacitive coupling.

14. The electrical connector of claim 9, wherein the electro-mechanical compensation is electrically coupled to the front signal traces and the rear signal traces.

15. The electrical connector of claim 9, wherein the electro-mechanical compensation includes interdigital fingers coupled to each signal trace, the interdigital fingers coupled to a front signal trace positioned between the interdigital fingers coupled to a rear signal trace.

16. The electrical connector of claim 9 further comprising mating contacts, each mating contact coupled to a signal trace, each signal trace conveying an electrical signal between a wire terminal and a mating contact.

* * * * *